US005940908A

United States Patent [19]

Gladney

[11] Patent Number: 5,940,908

[45] Date of Patent: Aug. 24, 1999

[54] REINFORCED BEDDING FOUNDATIONS

[75] Inventor: Ricky Gladney, Fairburn, Ga.

[73] Assignee: Simmons Company, Atlanta, Ga.

[21] Appl. No.: 08/951,248

[22] Filed: Oct. 16, 1997

[51] Int. Cl.[6] ..... A47C 23/05

[52] U.S. Cl. ..... 5/246; 5/263; 5/264.1

[58] Field of Search ..... 5/246, 239, 261, 5/236.1, 264.1, 255, 263

[56] References Cited

U.S. PATENT DOCUMENTS

| | | | |
|---|---|---|---|
| 3,717,886 | 2/1973 | Watts | 5/239 |
| 3,824,639 | 7/1974 | Mandusky | 5/264.1 |
| 4,399,573 | 8/1983 | Baright | 5/239 |
| 4,519,107 | 5/1985 | Dillion et al. | 5/261 |
| 4,644,596 | 2/1987 | Husler | 5/236.1 |
| 4,866,798 | 9/1989 | Harris | 5/264.1 |
| 5,459,892 | 10/1995 | Wells et al. | 5/239 |
| 5,485,640 | 1/1996 | Workman | 5/264.1 |

*Primary Examiner*—Michael F. Trettel
*Assistant Examiner*—Fredrick Conley
*Attorney, Agent, or Firm*—Jones, Day, Reavis & Pogue

[57] ABSTRACT

A structural frame having laterally extending L-shaped braces for reinforcing resilient and non-resilient bedding foundations.

20 Claims, 3 Drawing Sheets

REINFORCED BEDDING FOUNDATIONS

BACKGROUND OF THE INVENTION

1. Field of the Invention

The field of the present invention relates to reinforced bedding foundations and, in particular, to structural frames which provide reinforcement to increase the resistance to deflection under load of either resilient or non-resilient foundations for mattresses.

2. Description of Related Art

In the bedding industry, foundations for mattresses may be of resilient or non-resilient construction. Generally, resilient foundations are of a type referred to as "box-spring" constructions wherein structural frames are employed with assemblies of wire springs supported on the structural frames and with padded upper surfaces applied over the springs. Normally, this entire construction is encased within a pre-sewn ticking that is stapled or otherwise tacked to the underside of the structural frame around its periphery. Usually, a dust cover formed from a light plastic film or like material is applied to the underside of the structural frame. Examples of such constructions are disclosed in U.S. Pat. No. 4,339,573, issued to Baright and in U.S. Pat. No. 4,519,107, issued to Dillon et al, both of which are assigned to the common assignee herein, the disclosures of which are expressly incorporated herein by reference.

In conventional non-resilient foundations, the springs of the resilient constructions are absent and the mattresses rest on support assemblies such as wire or plastic loops, nets or screens, wooden or plastic blocks and the like which are attached to and extend from the structural frames. Padded upper surfaces are applied over the support assemblies and, normally, this entire construction is encased within a pre-sewn ticking that is stapled or otherwise tacked to the underside of the structural frame around its periphery with a dust cover applied to the underside of the structural frame.

Traditionally, both resilient and non-resilient foundations have been produced utilizing unreinforced wooden structural frames consisting of perimeter frames of flat lumber that have side rails and end rails nailed together at the frame corners and numerous cross slats spanning the frame, with or without a center rail. Such constructions were found to be adequate in strength to carry normal loads with only peripheral support. However, such frames have been found to exhibit substantial deflection under load and may, in time, develop a degree of permanent deflection. This permanent deflection interferes with the foundation's intended function of providing a planar support surface for the mattress.

A sagging foundation is indicated by the sagging or tilting of the mattress it carries which interferes with the essential function of the mattress, i.e., to uniformly support an outstretched body despite the uneven distribution of the body's weight. In addition, the foundation may exhibit a permanent sag, which is reflected in the mattress as a depression that is considered unsightly and unattractive.

To remedy these shortcomings, the inventions embodied in U.S. Pat. Nos. 4,399,573 and 4,519,107 are proposed wherein longitudinally extending support beams are secured to the upper surface of the cross slats of the structural frame of a foundation. For example, in U.S. Pat. No. 4,399,573, L-shaped frame stiffening braces or beams are secured to the upper surface of the cross slats of a structural frame and these frame stiffening beams extend longitudinally substantially the entire length from a head end to a foot end of the frame. These longitudinal beams are positioned so that they do not interfere with the resilient deflection in the foundation, and do not alter the smooth outline of either the upholstered top surface or the undersurface of a box-spring.

In the construction of U.S. Pat. No. 4,519,107, hollow cylindrical stop members are disclosed for limiting the amount that springs in a resilient foundation can be compressed. In that patent, it is disclosed that supporting L-shaped braces or beams may also be employed. The L-shaped braces or beams disclosed for use in that constructions are of the same type as those disclosed in U.S. Pat. No. 4,399,573 which extend longitudinally substantially the entire length of the frame from head to foot and may be accompanied by other beams or braces which likewise extend longitudinally but for a shorter distance.

However, despite the advances made possible by the inventions embodied in U.S. Pat. Nos. 4,399,573 and 4,519,107, it has been found that foundations which make use of longitudinally extending braces or beams nevertheless exhibit a certain level of deflection when normal loads are encountered. In time (i.e., after extended use), these foundations may also suffer permanent sagging that interferes with the essential function of the mattress and may result in the mattress having an unsightly sagging appearance.

Also, foundations constructed utilizing longitudinally extending support braces or beams require the use of significant amounts of materials in fabrication and, particularly, when the braces or beams extend substantially from head to foot of the structural frame as is disclosed in both of U.S. Pat. Nos. 4,399,573 and 4,519,107. Thus, these constructions clearly utilize more material than would be desirable and, thereby, result in both added cost and weight of the foundations. In addition, it has been found that structural frames for use in bedding foundations employing longitudinally extending reinforcing braces or beams have a tendency to exhibit tensile failure at joints when fasteners such as nails, staples and like fasteners are employed to interconnect frame members since the fasteners are not in shear with the load applied thereto when the braces or beams are longitudinally oriented.

SUMMARY OF THE INVENTION

The purpose of the present invention is to provide improved reinforced bedding foundations and, in particular, to provide reinforcement for otherwise conventional structural frames to stiffen them against deflection under normally-encountered loads borne by the frame irrespective of the type of assembly used whether it is resilient or non-resilient. Furthermore, the present invention improves over and resolves the shortcomings of prior art foundations by providing constructions wherein frame-stiffening, deflection-reducing reinforcement elements structured as L-shaped braces or beams are positioned to extend laterally of the structural frames and are secured to the upper surfaces of the side rails and center supports within the foundation. Like the braces or beams disclosed in U.S. Pat. No. 4,399,573 and U.S. Pat. No. 4,519,107, the L-shaped braces or beams of this invention can be oriented for the most favorable disposition of the brace or beam section without interfering with the resilient deflection in the foundation, and without altering the smooth outline of either the upholstered top surface or the undersurface of the foundation.

When compared to the longitudinal placement disclosed in U.S. Pat. No. 4,399,573 and U.S. Pat. No. 4,519,107, however, the lateral orientation of the L-shaped braces or beams reduces the effective support span of the assembly by 25% to 50%. This span reduction results in 10% to 20% less vertical deflection in the structural frame when loaded with an ordinary 250 pound to 500 pound test load centered on a 9"×18" platen. The lateral orientation also permits utilization of the existing cross slats as the horizontal web members of the L-shaped braces or beams, permitting savings in both material cost and weight of the construction.

Additionally, in the constructions of the present invention, the mattress support assembly whether resilient (e.g., springs) or non-resilient (e.g., blocks or wire supports), is positioned on and is directly supported by a horizontal flange of the laterally extending L-shaped braces or beams, thereby eliminating the tensile failure of joints not in shear with the load applied. Finally, the lateral L-shaped brace or beam construction allows for improved continuity with current assembly methods.

BRIEF DESCRIPTION OF THE DRAWINGS

The foregoing and other novel features of the present invention will become apparent upon reading the following detailed description taken in conjunction with the accompanying drawings in which.

DETAILED DESCRIPTION OF THE INVENTION

Figure 1:
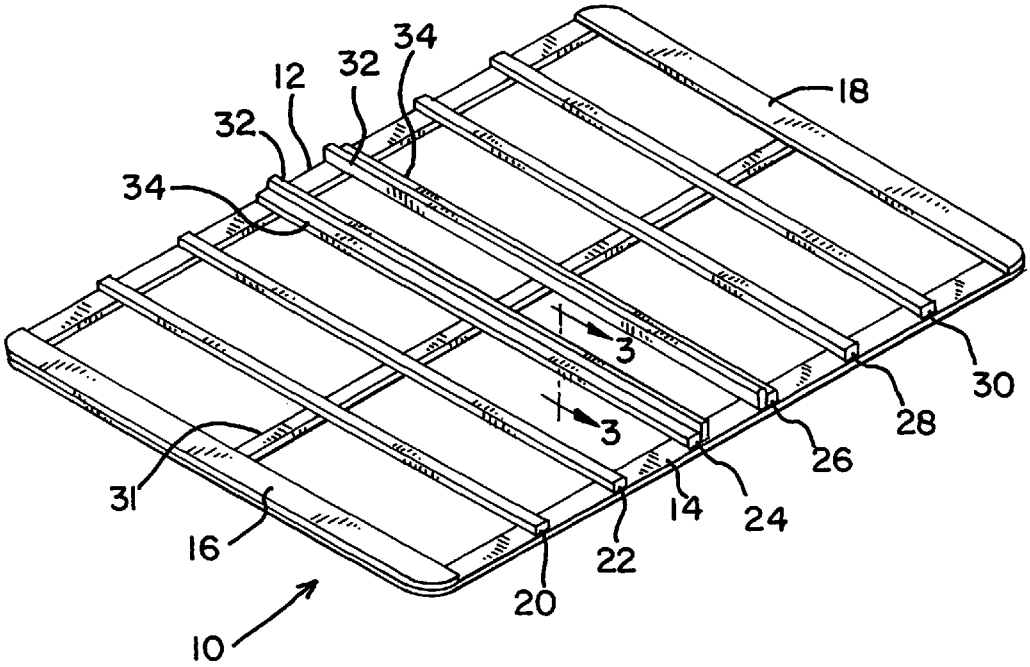
FIG. 1 is a perspective view of a structural frame for a bedding foundation according to this invention.

Referring now to the drawings, and initially to FIG. 1, a structural frame of the present invention (designated generally by the reference numeral 10) for use in construction of foundations for mattresses or the like (designated in various illustrations herein by the general reference numerals 11*a*, 11*b*, 11*c* and 11*d*). The structural frame 10 has a rectangular border including a pair of side rails 12 an 14, which may be formed from standard lumber of construction grade in nominal 1×3 size, connected at a head end of the frame 10 by a head end rail 16 and at the foot end of the frame 10 by a foot end rail 18.

The end rails 16 and 18 may be formed, for example, from a lower 1×2 end filler slat which butts the side rails 12 and 14 in the plane thereof, and from an upper 1×4 board which spans the side rails 12 and 14. Cross slats 20, 22, 24, 26, 28 and 30 are positioned on the upper surfaces of the side rails 12 and 14 and extend laterally to span the transverse distance between the side rails 12 and 14. Optionally, a longitudinally extending center support rail 31 may be attached to an undersurface of the head and foot rails and secured to an underside of each of the cross slats 20–30 as illustrated in FIG. 1 to provide additional structural integrity and strength for the frame 10.

As further illustrated in FIG. 1, it will be seen that cross slats 24 and 26 preferably are centrally positioned along the length of the frame 10 and are formed in an L-shaped configuration. However, it should be noted that the cross slats may be positioned elsewhere along the length of the frame 10 as desired and, although only two L-shaped cross slats are depicted in the drawings, it is to be recognized that a single such cross brace may be employed or more than two such reinforcing braces may be incorporated in the constructions of the present invention, if desired. Likewise, although the two L-shaped cross slat braces 24 and 26 are illustrated herein as being spaced equidistantly from a lateral centerline of the cross slat and with the cross-sections of the braces oriented for symmetry on the frame, such structural configuration is to be recognized as being preferable in the present invention although other constructions are envisioned within the scope of this invention.

The L-shaped cross slats 24 and 26 which extend laterally from one side rail 12 to the other side rail 14 are included in the structural frame 10 to provide deflection-reducing reinforcement for the frame 10 and, thus, these L-shaped cross slats 24, 26 act as reinforcing braces or beams for a variety of mattress support assemblies designated generally by reference numerals 36*a*, 36*b*, 36*c* and 36*d* for bedding foundations 11*a*, 11*b*, 11*c* and 11*d*, respectively, as illustrated in FIGS. 2 and 5–7 herein.

Figure 2:
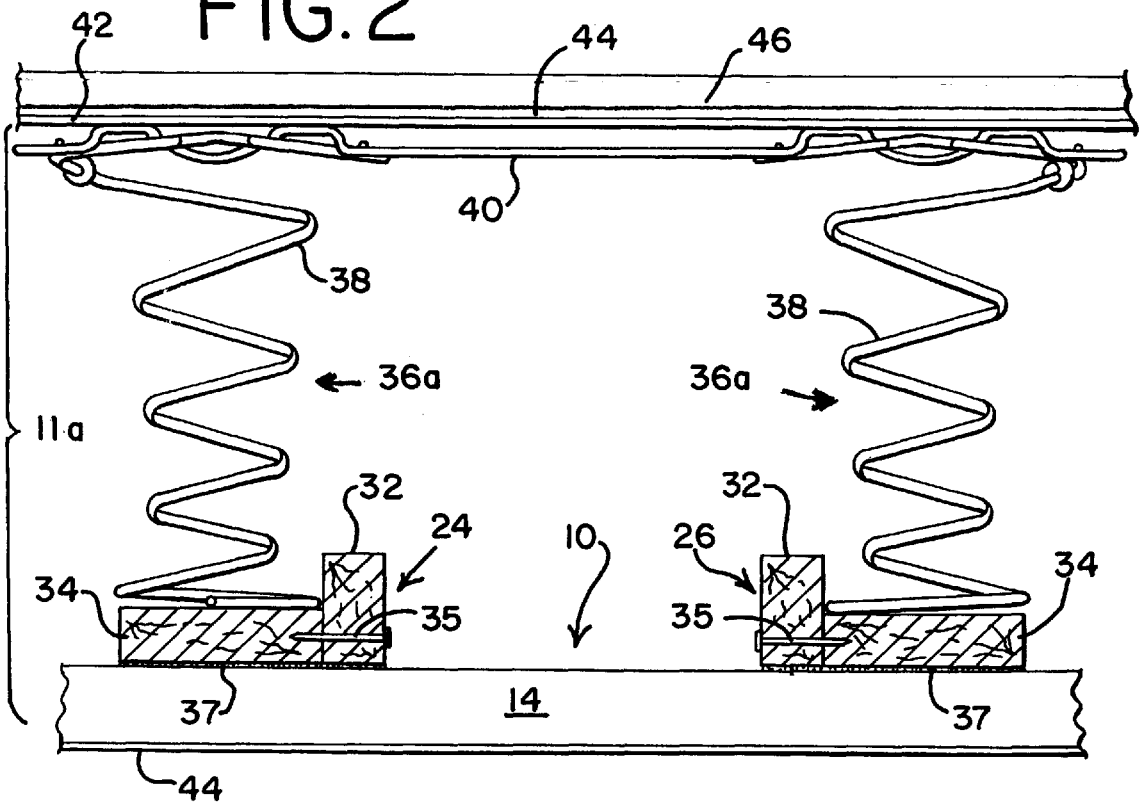
FIG. 2 is a longitudinal side elevation view of the structural frame of FIG. 1 installed in a resilient bedding foundation showing coil springs positioned on the frame with a grid overlaying the frame and supporting a mattress.
Figure 3:
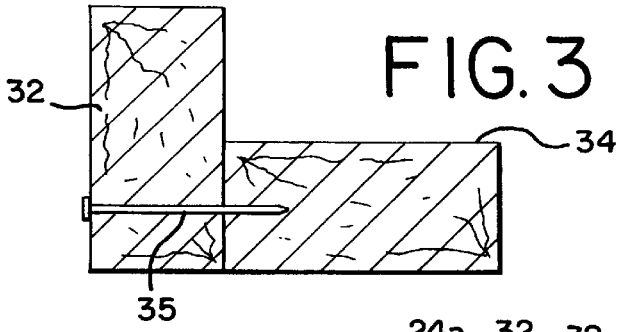
FIG. 3 is a sectional view of the laterally disposed L-shaped brace portion of the structural frame taken along line 3—3 in FIG. 1.
Figure 4:
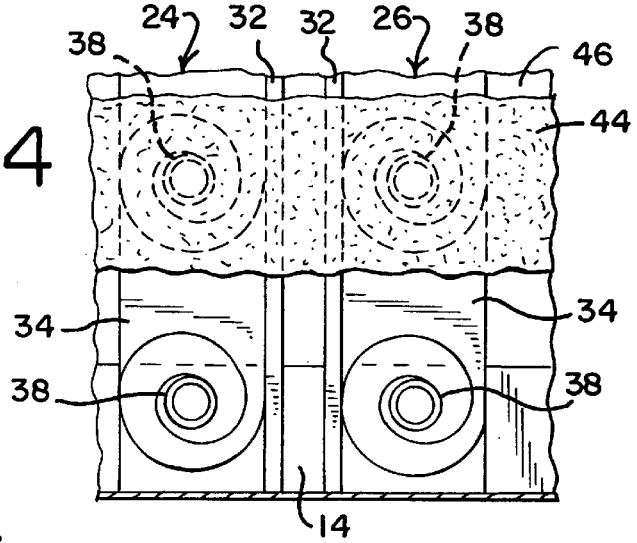
FIG. 4 is a partially cutaway top view of the bedding foundation of FIG. 2 showing coil springs positioned on the structural frame.

The L-shaped reinforcing cross slats or braces 24 and 26 may be constructed from any suitable material such as lumber, plastics, metals and the like and may be formed as an integral one-piece element, for example, by molding, shaping, forging and the like or may be formed into a unitary assembly from separate members by any known procedure, such as nailing, stapling, screwing, gluing and the like, in combination or alone, as desired. However, as illustrated in FIGS. 1–3, representative L-shaped cross slat 24 is formed from wood and consists of two joined parts including an upstanding web section 32 extending vertically upwardly from the frame 10 and a flange section 34 extending horizontally lengthwise of the frame 10. The upstanding web section 32 and the flange section 34 of the cross slat 24 are fastened together by nail 35, although it will be recognized that these sections 32,34 may be joined by any appropriate fastening procedure.

In assembly, the L-shaped reinforcing cross slats 24, 26 may be oriented so that the section thereof which receives a connecting nail, staple, screw or other fastener or is glued edgewise becomes the flange section 34 of the slat, and the other section of the L-shaped assembly becomes the upstanding web section 32. This orientation stresses the fastener in shear, avoiding the risk that the fastener will pull out or separate under tensile load. Also, as illustrated herein, the L-shaped reinforcing cross slat braces 24, 26 are secured to the upper surfaces of the side rails 12 and 14 by applying glue or adhesive 37 therebetween, although it will be recognized that these surfaces may be secured by any other known fastening method such as nailing, stapling, screwing and the like, alone or in combination, as desired. Also, as shown in FIG. 1, the L-shaped reinforcing cross slat braces 24, 26 may be aligned so that their flange sections 34 are facing in opposite longitudinal directions. However, if desired, the flanges may be positioned in facing alignment.

As illustrated in FIGS. 2 and 4–7, the flange sections 34 on L-shaped braces 24, 26 are structured and dimensioned to accommodate a variety of resilient and non-resilient mattress support assemblies designated variously herein as 36*a*, 36*b*, 36*c* and 36*d*. For example, in the embodiment of the invention shown in FIGS. 2 and 4, the mattress support assembly 36*a* is a resilient box-spring including a plurality of rows of conical shaped coil springs 38. In this construction, a plurality of coil springs 38 are seated on the flange sections 34 of the L-shaped braces 24, 26 and a coil connecting wire frame 40 is mounted to the tops of the springs 38. Cushioning material 42 is supported by the wire frame 40 and a cover or ticking 44 is provided forming the exterior surface for the entire foundation 11*a*. As illustrated, a mattress 46 is supported on the mattress support assembly 36*a*.

Figure 5:
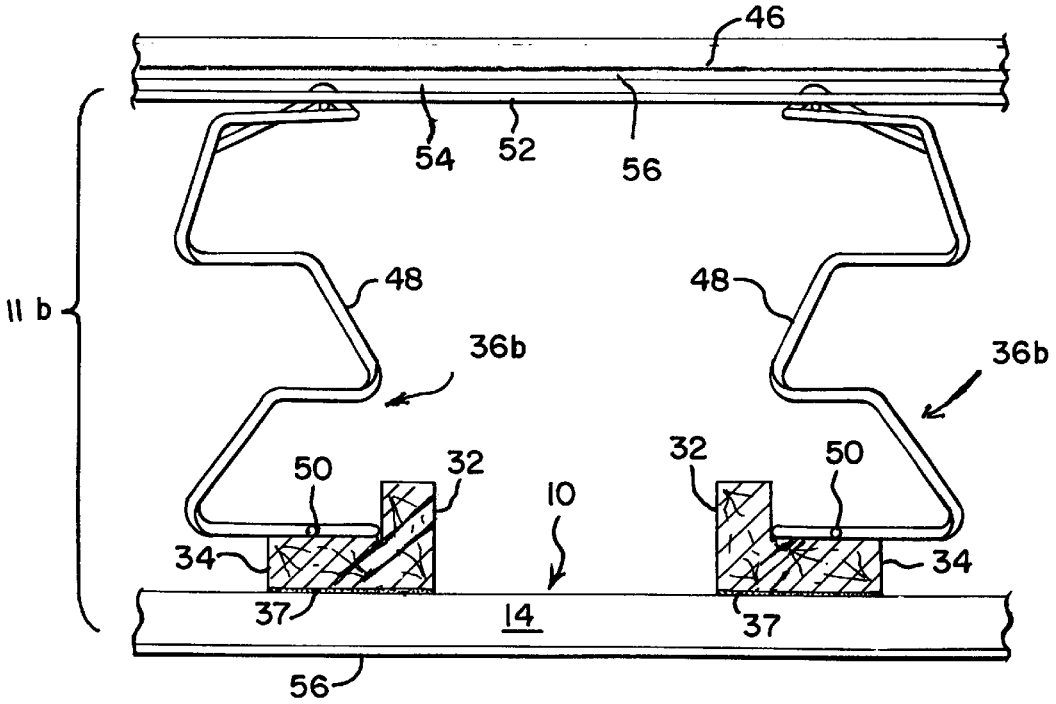
FIG. 5 is a longitudinal side elevation view of the structural frame of FIG. 1 installed in a resilient bedding foundation showing torsion springs positioned on the frame with a grid overlaying the frame and supporting a mattress.

In the embodiment of the invention shown in FIG. 5, the L-shaped braces 24,26 are formed as integral one piece wooden members and are secured to the side rails 14,16 by applying glue 37 therebetween. The mattress support assembly 36*b* is a resilient box-spring including a plurality of rows of torsion springs 48. In this construction, a plurality of torsion springs 48 are supported on and attached to the flange sections 34 of the L-shaped braces 24, 26 by fasteners 50 and a coil connecting wire frame 52 is mounted to the tops of the springs 48. As in the embodiment of this invention illustrated in FIGS. 2 and 4, cushioning material 54 is supported by the wire frame 48 and a cover or ticking 56 is provided to form the exterior surface for the entire foundation 11*b*. A mattress 46 is supported on this mattress support assembly 36*b*.

From the above, it should be clear that spring assemblies for use in the box-spring assemblies of this invention may vary in form and construction and the springs for use therein may be of any selected type such as coil, elemental, leaf, modular or torsion springs. The prior art suggests a variety of other spring forms in addition to these conventional commercial forms. For purposes of the present invention, the particular type or form of spring assembly employed is optional.

Figure 6:
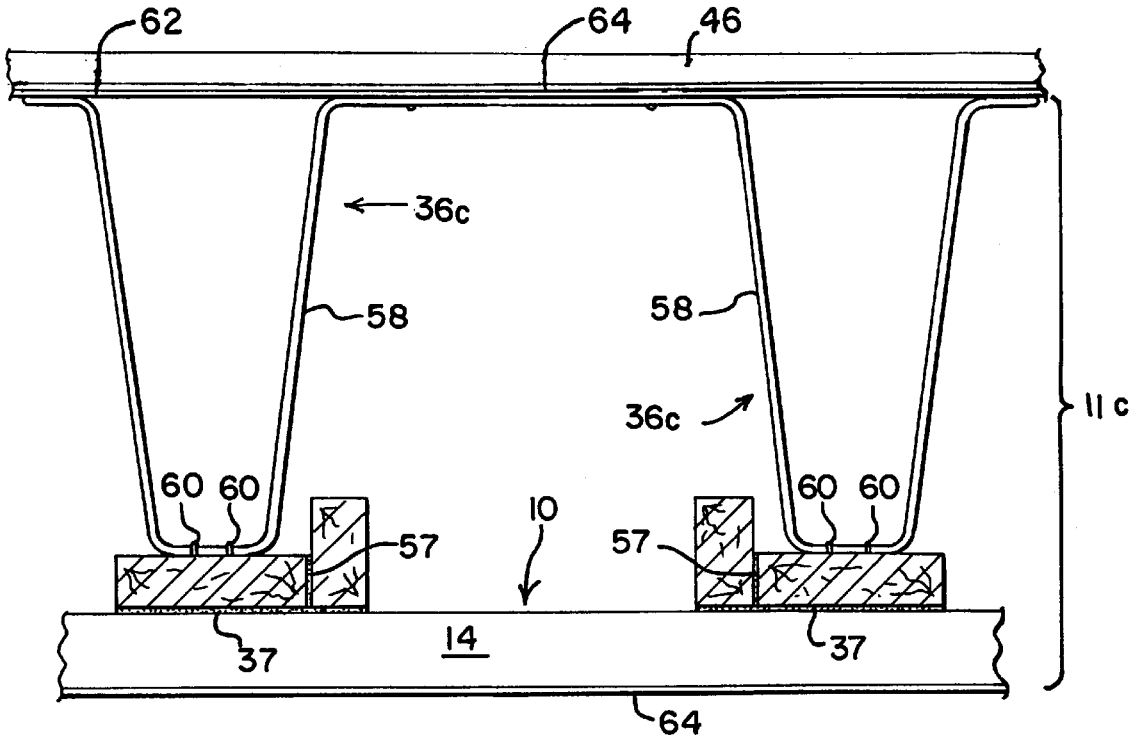
FIG. 6 is a longitudinal side elevation view of the structural frame of FIG. 1 installed in a non-resilient bedding foundation showing wire supports positioned on the frame and supporting a mattress.

As illustrated in FIG. 6, a non-resilient bedding foundation 11*c* is provided employing the mattress support assembly 36*c*. In this construction, the L-shaped braces are affixed to the structural frame 14 by glue 37. The upstanding web section 32 and the flange section 34 of the L-shaped braces are joined by applying glue 57 therebetween and a mattress support assembly 36*c* comprises a plurality of wire support members 58 supported on and attached to the flange sections 34 of the L-shaped braces 24, 26 by fasteners 60. In this embodiment, cushioning material 62 is applied over the assembly 36*c* and a cover or ticking 64 is provided to form the exterior surface for the entire foundation 11*c*. A mattress 46 is supported on the mattress support assembly 36*c*.

Figure 7:
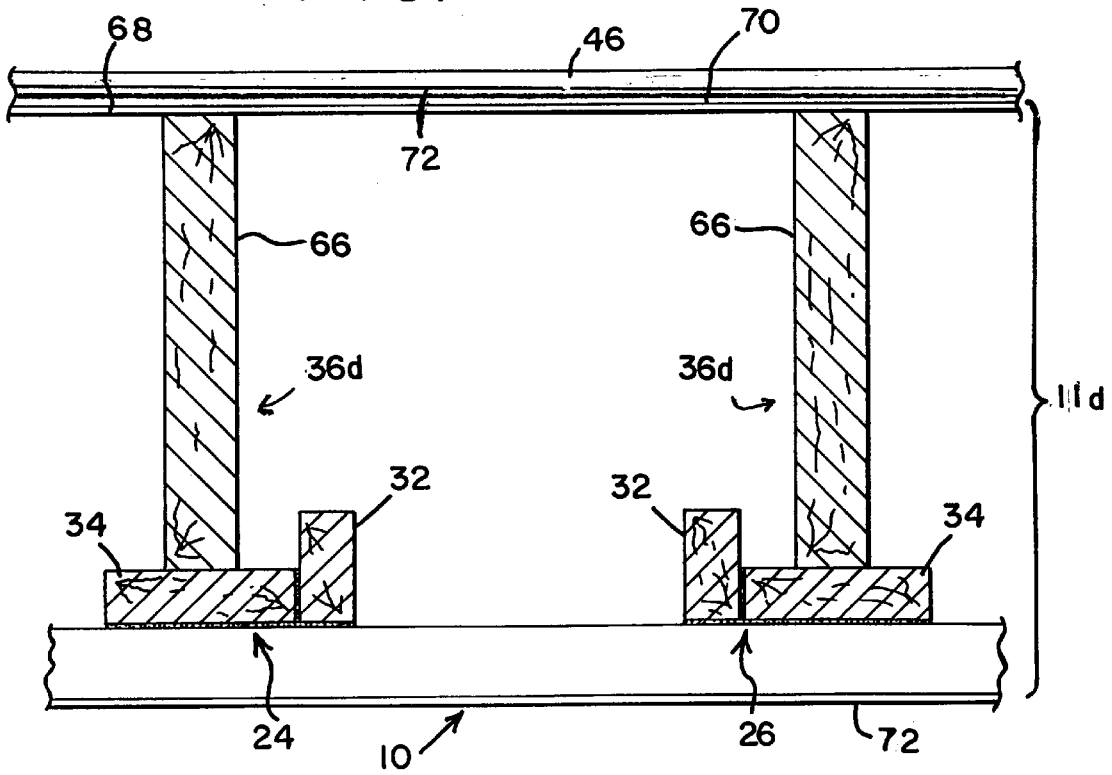
FIG. 7 is a longitudinal side elevation view of the structural frame of FIG. 1 installed in a non-resilient bedding foundation showing wooden blocks positioned on the frame and supporting a mattress.

FIG. 7 shows another embodiment of the invention providing a non-resilient foundation lid employing a support assembly 36*d*. In this construction, the mattress support assembly 36*d* includes a plurality of rigid upstanding wooden block support members 66 supported on and attached to the flange sections 34 of the L-shaped braces 24, 26 and a linear board member 68 which rests on the block supports 66. In this embodiment, cushioning material 70 is applied over the assembly 36*d* and a cover or ticking 72 is provided to form the exterior surface for the entire foundation 11*d*. A mattress 46 is supported on the mattress support assembly 36*d*.

To illustrate the effectiveness of the reinforced structural frames disclosed herein, comparative tests have been conducted of the present products employing laterally extending L-shaped reinforcing cross slats in relation to structural frames constructed in accordance with the disclosure in U.S. Pat. No. 4,399,573, wherein a longitudinal orientation of L-shaped reinforcing cross slats is employed for otherwise identically constructed products. As a result of that testing, it has been determined that bedding produced in accordance with the present invention having the laterally disposed orientation of the L-shaped reinforcing braces demonstrates marked reduction of frame deflection under identical loadings as compared with the prior art products. Specifically, as previously described, the use of laterally disposed L-shaped reinforcing cross slat braces results in 10% to 20% less vertical deflection in the frame foundation when loaded with an ordinary 250 pound to 500 pound test load centered on a 9"18" platen when compared to the bedding products produced in accordance with the disclosure in U.S. Pat. No. 4,399,573.

It can now be appreciated that the change in orientation of the L-shaped reinforcing cross slat braces from longitudinal to lateral disposition provides a structural frame of demonstrably greater resistance to deflection, and one which is therefor capable of providing a foundation which is more adequately suited to its function and purpose of providing a plane and level support for a mattress when the bed is occupied, as well as maintaining the level and trim appearance of the bed when not in use.

The lateral orientation of the reinforcing members of the present invention also permits savings in materials and weight through utilization of the existing cross slats as the horizontal web members of the L-shaped beam, it allows for improved continuity with current assembly methods and because the mattress support assemblies are applied directly to the horizontal flange of the L-shaped brace in the lateral orientation, the tensile failure of joints not in shear with the load applied is essentially eliminated.

While the present invention has been described in connection with preferred embodiments thereof, it will be understood by those skilled in the art that many changes and modifications may be made without departing from the spirit and scope of the invention. Accordingly, it is intended by the appended claims to cover all such changes and modifications which come within the true spirit and scope of the invention.

What is claimed is:

1. A bedding foundation for supporting a mattress comprising:

a mattress support assembly;

a frame having a rectangular border including first and second spaced side rails extending in a longitudinal direction and a head end rail and a foot end rail disposed laterally of the side rails, the first and second side rails being connected at opposite ends by the head end and foot end rails;

a plurality of cross slats positioned on an upper side of the side rails of the frame and extending laterally of the side rails and spanning the space between the side rails intermediate the head end and the foot end rails;

deflection-reducing reinforcement elements comprising at least one L-shaped cross slat brace positioned on the upper side of the side rails of the frame and extending laterally of the side rails and spanning the space between the side rails intermediate the head end and the foot end rails; and the L-shaped brace having an upstanding web section extending vertically upwardly from the frame and a horizontal flange section extending horizontally lengthwise of the frame to provide an upwardly projecting horizontal upper flange face extending laterally between the side rails so that the flange section on the L-shaped brace is structured and dimensioned to accommodate the mattress support assembly directly on the upper flange face.

2. The structural frame of claim 1 including two L-shaped cross slat braces.

3. The structural frame of claim 2 wherein the two L-shaped cross slat braces are substantially centrally positioned intermediate the head end rail and the foot end rail.

4. The structural frame of claim 2 wherein the two L-shaped cross slat braces are spaced equidistantly from a lateral center-line of the cross slat, and the cross-sections of said braces are oriented for symmetry on the frame.

5. The structural frame of claim 1 including a longitudinally extending center support rail attached to the head and foot rails and secured to an underside of each of the cross slats.

6. The structural frame of claim 1 wherein the flange section of the L-shaped brace is structured and dimensioned to enable a resilient mattress support assembly to be attached directly to the upper flange face.

7. The structural frame of claim 6 wherein the resilient mattress support assembly includes springs.

8. The structural frame of claim 7 wherein the springs employed in the resilient mattress support assembly are selected from the group consisting of coil, elemental, leaf, modular and torsion springs.

9. The structural frame of claim 1 wherein the flange section of the L-shaped brace is structured and dimensioned to enable a non-resilient mattress support assembly to be attached directly to the upper flange face.

10. A reinforced bedding foundation for supporting a mattress comprising:

a structural frame including:

a border formed from first and second spaced side rails extending in a longitudinal direction and a head end rail and a foot end rail disposed laterally of the side rails with the first and second side rails connected at opposite ends by the head end and foot end rails;

a plurality of cross slats positioned on an upper side of the side rails and extending laterally of the side rails and spanning the space between the side rails intermediate the head end and the foot end rails; deflection-reducing reinforcement elements comprising at least one L-shaped cross slat brace positioned on the upper side of the side rails and extending laterally of the side rails and spanning the space between the side rails intermediate the head end and the foot end rails;

the L-shaped brace having an upstanding web section extending vertically upwardly from the frame and a horizontal flange section extending horizontally lengthwise of the frame to provide an upwardly projecting horizontal upper flange face extending laterally between the side rails; and a mattress support assembly supported directly on the upper flange face of the L-shaped brace.

11. The reinforced bedding foundation of claim 10 wherein the structural frame includes two L-shaped cross slat braces.

12. The reinforced bedding foundation of claim 11 wherein the two L-shaped cross slat braces are substantially centrally positioned intermediate the head end rail and the foot end rail.

13. The reinforced bedding foundation of claim 11 wherein the two L-shaped cross slat braces are spaced equidistantly from a lateral center-line of the cross slat, and the cross-sections of said braces are oriented for symmetry on the frame.

14. The reinforced bedding foundation of claim 10 wherein the structural frame includes a longitudinally extending center support rail attached to the head and foot rails and secured to an underside of each of the cross slats.

15. The reinforced bedding foundation of claim 10 wherein the mattress support assembly is structured and dimensioned to provide a resilient foundation for the mattress.

16. The reinforced bedding foundation of claim 15 wherein the mattress support assembly includes springs.

17. The reinforced bedding foundation of claim 16 wherein the springs employed in the mattress support assembly are selected from the group consisting of coil, elemental, leaf, modular and torsion springs.

18. The reinforced bedding foundation of claim 10 wherein the mattress support assembly is structured and dimensioned to provide a non-resilient foundation for the mattress.

19. The reinforced bedding foundation of claim 18 wherein the mattress support assembly is selected from the group consisting of wire support members and wooden blocks.

20. The reinforced bedding foundation of claim 10 wherein the mattress support assembly is fixedly attached to the upper flange face of the L-shaped brace.

* * * * *